United States Patent [19]

Stark

[11] Patent Number: 5,033,235

[45] Date of Patent: Jul. 23, 1991

[54] WINDOW JAMB LINER WITH CONCEALED SPRING POCKET AND FRICTION SLIDE

[75] Inventor: Ivan L. Stark, Ada, Mich.

[73] Assignee: Newell Manufacturing Company, Lowell, Mich.

[21] Appl. No.: 516,089

[22] Filed: Apr. 27, 1990

[51] Int. Cl.[5] ..... E05F 3/00

[52] U.S. Cl. ..... 49/445; 49/429

[58] Field of Search ..... 49/445, 446, 429, 451, 49/415; 16/193, 197

[56] References Cited

U.S. PATENT DOCUMENTS

| | | | |
|---|---|---|---|
| 3,466,806 | 9/1969 | Teggelaar et al. | 49/451 X |
| 3,499,248 | 3/1970 | Baer | 49/446 X |
| 3,524,282 | 8/1970 | Kraft et al. | 49/445 X |
| 3,788,006 | 1/1974 | Teggelaar et al. | 49/451 X |
| 4,015,367 | 4/1977 | De Bruyn | 49/451 |
| 4,570,382 | 2/1986 | Suess | 49/445 X |
| 4,571,887 | 2/1986 | Haltof | 49/429 |
| 4,763,447 | 8/1988 | Haltof et al. | 49/445 X |
| 4,779,380 | 10/1988 | Westfall | 49/445 X |

*Primary Examiner*—Philip C. Kannan

*Attorney, Agent, or Firm*—Price Heneveld Cooper DeWitt & Litton

[57] ABSTRACT

A jamb liner, or facing member, for movably mounting windows along their side edges in channels or runs, in which a concealed elongated chamber is provided for a coil spring or the like used as part of the balance or positioner mechanism by which the window is supported in different positions along the length of the jamb as it is opened and closed during use. Preferably, such concealed chamber includes an elongated wall which projects outwardly from the jamb liner and has an arcuate or other angularly-configured cross-section, such that it presents a generally closed appearance when viewed from a position near the window. Such chamber-concealing wall defines an elongated opening through which the balance device may communicate for access by the window sash, for supporting the latter and positioning it. In addition, a novel balance apparatus is disclosed which comprises a friction shoe configured to slidably move within the aforementioned chamber and frictionally engage a rib extending therewithin, as a function of and in response to the applied weight of the sash.

26 Claims, 2 Drawing Sheets

WINDOW JAMB LINER WITH CONCEALED SPRING POCKET AND FRICTION SLIDE

FIELD OF THE INVENTION

This invention relates to window jamb liners and friction balance constructions used therewith, by which vertically hung windows are mounted and provide with spring-biased positioning support so that the window operator need only use minor effort to cause movement of the sash in either direction. More particularly, the invention relates to jamb liner configuration which conceals a suspension spring, together with a friction balance device which provides resistance to sash movement that is responsive to the weight of the sash and, thus, increases with a heavier sash and decreases with a lighter sash and, as a result, can be used with a variety of sash having a wide range of sizes and weights.

BACKGROUND OF THE INVENTION

It has long been customary practice in the fenestration field to use tension springs as one of the means for counterbalancing the weight of single or double hung, vertically slidable window sash. Numerous techniques have been utilized in conjunction with such springs to provide a sash support which will hold the sash stationary in any given vertical position when the operator releases it, yet permit the operator to raise or lower it with minimal effort. Such balance systems employ a variety of techniques to assure that the sash will remain stationary when released by the operator and yet can be moved either upward or downward with reasonable ease by the operator. This has been accomplished in various ways, for example those disclosed in prior U.S. Pat. Nos. 3,788,006, 4,015,367, 4,570,382, 4,571,887, 4,763,447 and 4,779,380.

One problem with these prior developments is that they are more complex and more costly than is considered desirable in the construction of certain types of housing. When it has been attempted to reduce the cost, the balance devices or systems have become unreliable or unsatisfactory because they do not consistently or continuously balance the weight of the sash at all positions, and may either creep upward or downward from a selected position o else require substantial physical effort to move the sash into certain positions of adjustment. In either case, operation of the windows is frequently frustrating and difficult. Attempted solutions to overcome these difficulties have been restricted because of the stringent limitations relating to cost while maintaining simplicity of construction and the requisite reliability of operation.

A further undesirable aspect of prior tension spring and other such sash balance systems is the unesthetic and somewhat hazardous presence of the spring itself, together with related components, which is usually disposed in open visibility along each side of the jamb. While some effort has been made previously to conceal or protectively cover such spring (for example, prior U.S. Pat. Nos. 4,570,382 and 4,779,380), the resulting concealment was not complete or not effected in a way which was esthetically desirable.

SUMMARY OF THE INVENTION

The present invention provides a novel jamb liner configuration having a substantially fully concealed spring chamber which provides a highly pleasing esthetic appearance as well as enhanced safety and practicality, together with a simple but highly effective balance means by which the weight of the sash, opposed by the spring force, provides a braking effect, through a pair of inclined surfaces which react to the weight of the sash by generating frictional resistance to movement. The resulting balance effect does not interfere with intentional, easy operation of the sash by an operator, and at the same time positively holds the sash stationary when the operator is not applying force to it for the purpose of causing movement. The system is totally automatic in operation and is also automatically responsive to sash weight, without intervention by the installer. Thus, it is capable of being utilized with windows having a wide range of sash weights, without the necessity for providing a large inventory of sizes and constructions to accommodate the weight differentials. The invention provides a simple, compact and totally automatic system which is self-accommodating to the weight of the sash and of enhanced appearance. It is also inexpensive, easy and quick to install.

DESCRIPTION OF THE PREFERRED EMBODIMENT

In the following description, the apparatus of the invention is described as applied to only one side of a window. However, it is to be understood that will in fact be applied to both sides of the sash, and that the structure on each side will be basically identical. Therefore, a description for one side is adequate to explain the construction used on both sides of the sash.

Figure 1:
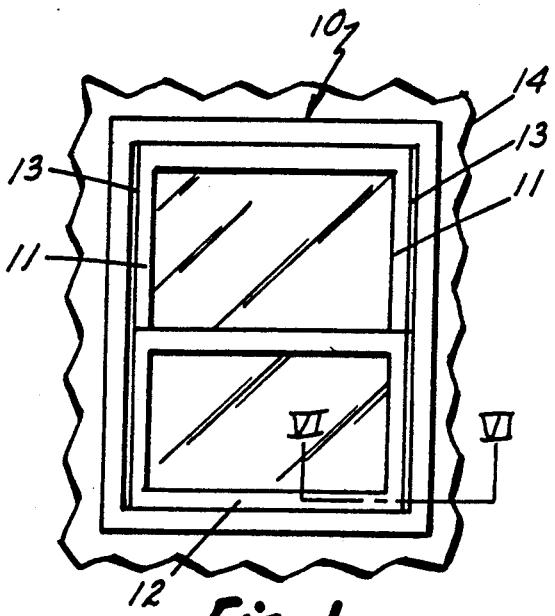
FIG. 1 is a fragmentary front elevational view of a window of the type to which this invention can be applied.
Figure 6:
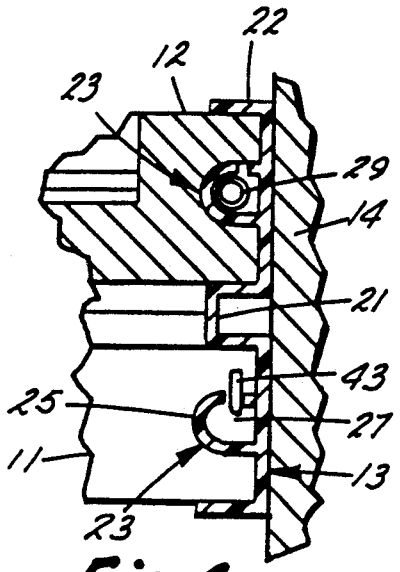
FIG. 6 is a fragmentary sectional view taken along the plane VI—VI of FIG. 1.

Referring to FIG. 1, the window 10 is of the double hung type, having an upper sash 11 and lower sash 12. The sash 11 and 12 are supported for sliding vertical movement between a pair of jamb liners 13 (FIG. 2), one on each side, which are secured to the window frame or jamb 14. The jamb liners 13 are preferably of polymeric material, e.g. vinyl, and are preferably extruded as a continuous member and cut to length as needed. At the time of window installation, the upper and lower sash are first fitted to and between a pair of the jamb liners 13, and the resulting assembly is then slid into place between and secured to the window frame by any suitable and effective fastener means, such as nails, screws or staples.

Figure 2:
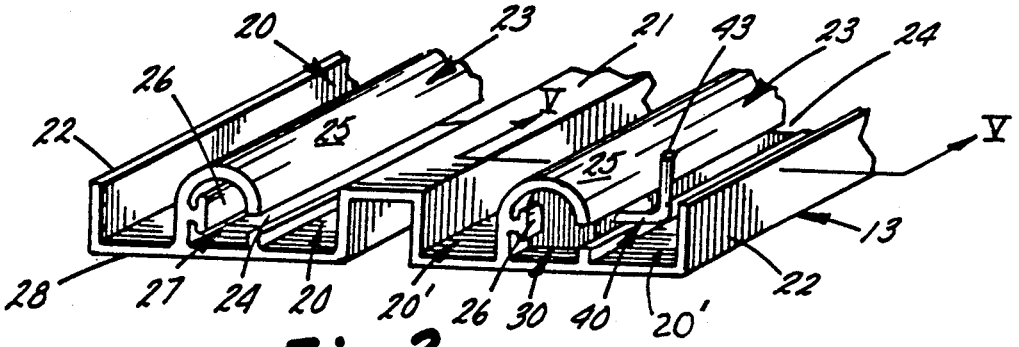
FIG. 2 is an enlarged, fragmentary perspective view of the lower end of a jamb liner in accordance with the invention, showing one friction slide.
Figure 5:
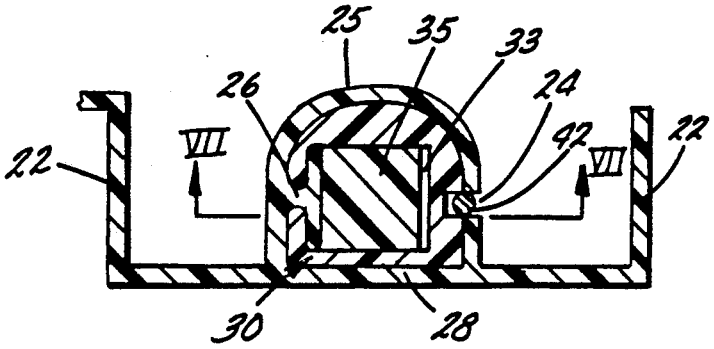
FIG. 5 is an enlarged, fragmentary sectional view taken along the plane V—V of FIG. 2.

Each of the jamb liners 13 has a pair of parallel sash channels or guideways 20, 20' (FIG. 2). The guideways 20 are separated by a mullion 21, with the outer edge of each of the tracks or guideways 20 being formed by a flange 22. Centered between the mullion 21 and each flange 22, each guideway 20 has a central guide structure and balance housing 23 which extends the entire length of the jamb liner 13 (FIG. 5). The central guide and balance housing 23 is defined by an elongated wall 25 which extends outwardly from the base 28 of the jamb liner generally parallel to the flange 22. In accordance with the present invention, the wall 25 serves to substantially enclose an internal volume except for a longitudinal slot 24. Integral with the wall 25 opposite slot 24, is a rib 26 of T-shaped cross section extending into the interior 27 of the balance housing 23, with the generally flat top of rib 26 facing the slot 24 (FIG. 2). The rib 26 also extends the full length of the jamb liner 13.

Figure 4:
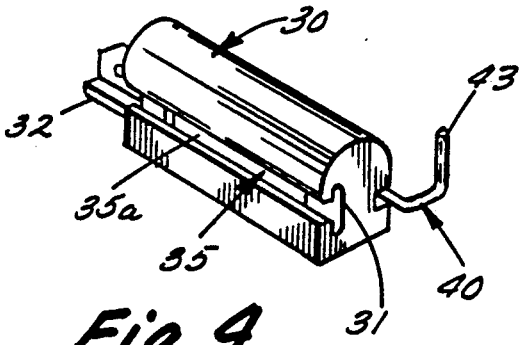
FIG. 4 is a perspective view of the shoe illustrated in FIG. 3.
Figure 7:
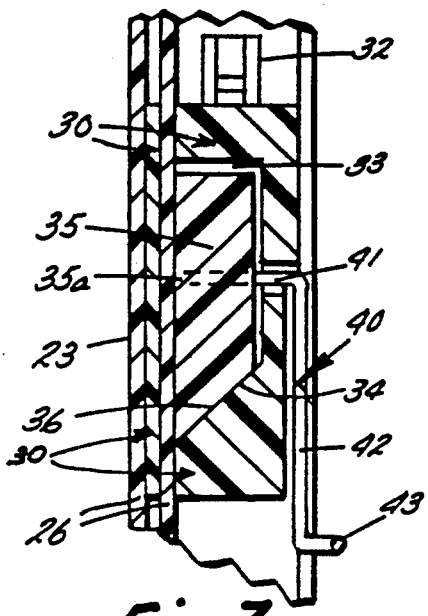
FIG. 7 is a fragmentary sectional elevational view taken along the plane VII—VII of FIG. 5.

Mounted within the balance housing 23 is a positioning shoe 30, one end of which is provided with a hook 32 (FIG. 8) so that the shoe can be connected to a tension spring 29. The shoe 30 has a body whose cross-sectional shape fits closely but slidably inside one of the balance housings 23. The shoe 30 has an elongated internal cavity 33 which extends lengthwise of the shoe and has an angular lower end wall 34 (FIG. 7). The outer end walls of the shoe 30 define a T-shaped opening 31 (FIG. 4) which extends the entire length thereof, through which the rib 26 is slidably movable. Between the end walls of shoe 30, the outer flange (i.e. the cross bar) of rib 26 passes through the internal cavity 33 along one of its elongated side extremities (FIGS. 5 and 7).

Mounted in the cavity 33 inside shoe 30 is a wedge 35 having a length shorter than that of the cavity and a cross-sectional size such that it fits closely but slidably within the cavity (FIG. 7). One side surface **35*a* of the wedge 35 directly faces and makes sliding contact with the rib 26 (FIGS. 5 and 7). The lower end wall 34 of cavity 33 (opposite the hook 32) is inclined at a major angle of about 45° downwardly toward the rib 26. The lower end 36 of wedge 35 is shaped to complement and cooperate with the cavity end wall 34, such that when the wedge 35 is urged toward end wall 34, the engagement of the two angularly inclined walls will press the side surface 35*a* of the wedge against the rib 26**.

Figure 3:
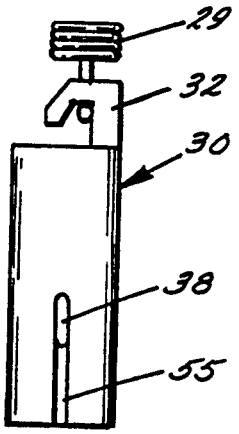
FIG. 3 is a further enlarged side elevational view of one of the friction slide shoes which connect the spring to the sash.

Mounted to the shoe 30 is a sash-engaging support member 40, the top end portion 41 of which extends through an elongated opening 38 in the shoe opening out of the side thereof opposite rib 26 (FIG. 3), and is press-fitted into a hole in the side of wedge 35 (FIG. 7). The opening 38 is elongated lengthwise of the central channel to permit limited corresponding movement of the wedge and sash support member 40 relative to the shoe 30. Sash support 40 has an intermediate portion 42 which extends along the side of and beyond the end of shoe 30, away from the hook 32 at the top of the shoe. The other end 43 of the sash support 40, opposite its end 41, extends under the sash 10 and supports the weight of the sash. Thus, the weight of the sash is applied to the sash support 40 and this is transmitted to the wedge 35, pressing it against the complementary angled end surface 34 of the cavity 33. This forces side **35*a* of the wedge 35 against the rib 26 with a force which is a function of the weight of the sash. Thus, the heavier the sash, the greater the pressure exerted by the wedge against the rib 26** and the greater the resistance to movement of the sash.

To overcome any eccentricity created by having the sash-engaging end portion 41 offset from the central axis of the shoe, i.e. connected to the side of the shoe rather than its end, the side wall of the shoe 30 through which recess 38 opens may be provided with a longitudinal recess 55 (FIG. 3) to seat the portion 42 of the sash support 40 which extends lengthwise of the shoe. This prevents pivoting of the sash support 40 about its point of attachment to the wedge 35. This construction is helpful because it confines all of the effects of the sash weight to the frictional engagement between the side **35*a* of the wedge and the stationary surface of the rib 26**.

Figure 9:
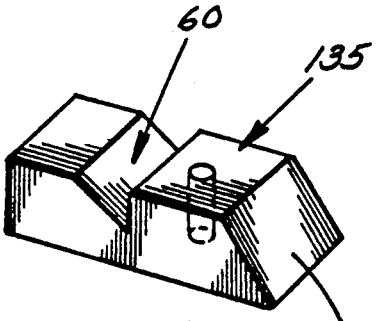
FIG. 9 is a perspective view of a portion of the shoe illustrated in FIG. 8.
Figure 8:
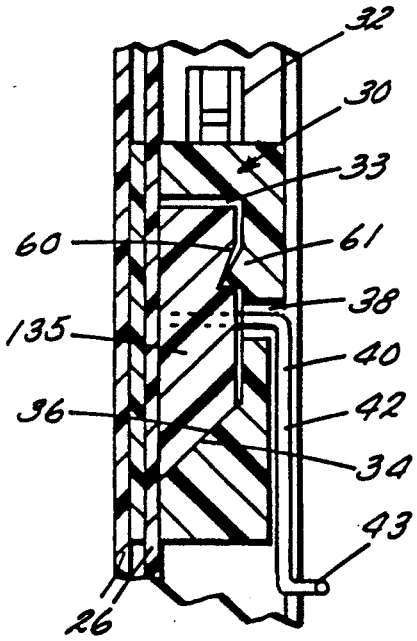
FIG. 8 is a fragmentary sectional elevational view taken along the same plane as FIG. 7 but illustrating a modified construction.

The pressure with which the wedge 35 is forced against the rib 26 can be increased and made more uniform by the use of a second inclined surface. This is illustrated in FIGS. 8 and 9, wherein the wedge 35 is provided with a wedge-shaped opening 60 positioned adjacent the top end of the shoe 30, opposite its inclined surface 36 and in the wall of the shoe facing away from the rib 26. The opening 60 cooperates with a wedge-shaped projection 61 extending from the inside wall of the shoe into cavity 33, and functions to urge the adjacent end portion of the shoe against the rib 26. This significantly increases the effective area of the shoe surface functionally engaging the rib 26, and provides a means for more effectively using this invention with particularly heavy sash. It is also useful in installations in which the plastic from which the guideways are extruded has a lower coefficient of fiction.

It will be recognized that the substantially fully enclosed positioner channel and spring cavity provided by the invention comprises a novel and desirable advance in the art in and of itself, which allows for substantially complete concealment of the operating components of the balance system. In addition, the new and improved friction balance system provided by the invention also comprises a valuable advance in and of itself, having its own advantages, and the combined use of these advances provides further advantages and enhancements, making possible the provision of a sash balance system having exceptional and distinctive appearance characteristics which also operates exceedingly well for the intended purpose. Of course, the major components of the invention are subject to varying implementations and differing applications, just as their use in combination may be varied and changed.

While the invention has been illustrated and described as applied to one side of a window sash, it will in actual practice also be applied on the other side of the sash. It will also be recognized that in a double hung window it will typically be applied to both sash. If one of the sash is fixed, then the springs and the means of attachment will be provided for the moveable window only even though the track has channels for both sash. While the invention has been described as one in which the sash, the tracks, the counterbalance springs and their attachments to the sash are assembled at point of use, the window and tracks with the counterbalance assembled as a package may if desired be shipped from the factory as a ready to install package.

Having described a preferred embodiment of my invention and a modification thereof, it will be recognized that other modifications can be made without departing from the principles of the invention. Such modifications are to be considered as included in the hereinafter appended claims, unless these claims, by their language, expressly state otherwise.

The embodiments of the invention in which an exclusive property or privilege is claimed are defined as follows.

1. A jamb liner and sash balance construction for window installations having a vertically slidable sash, comprising in combination: a jamb liner adapted to be disposed alongside the window sash and having elongated walls forming a track along which at least one of the sash may slide; said elongated walls defining a channel which extends along and lies adjacent the side edge of the sash slidable along said track, said channel being closed on all sides except for a slot-like opening extending lengthwise thereof and located in a position which is laterally offset from the central plane of said slidable sash and generally concealed from the position of a person slidably moving the sash; a frictional positioning shoe slidably disposed within said channel, said shoe having spring-attachment means at one end; a sash-supporting tension spring extending lengthwise of said channel, said spring having one end attached to said shoe by said attachment means and another end anchored with respect to said channel at a point remote from said shoe; said shoe having means for frictionally engaging portions inside said channel to retain the sash at selected positions therealong; and means for coupling said shoe to said sash so that the shoe may carry at least a portion of the weight of the sash and position the sash along said channel, said coupling means including a finger-like member extending through said slot-like opening and laterally along at least part of the outside of said channel walls in a direction toward said sash so as to engage said sash and transfer at least portions of its weight to said shoe.

2. The jamb liner and sash balance construction as defined in claim 1 wherein said channel has an elongated rib inside its said walls and extending longitudinally thereof, and wherein said shoe includes means for frictionally engaging said rib to position said sash along said channel.

3. The apparatus of claim 2, wherein said rib is located generally opposite said slot-like opening and across the interior of said channel with respect thereto.

4. The apparatus of claim 2, wherein said shoe has a recess having a cross-sectional size and shape to slidably receive at least portions of said rib.

5. The apparatus of claim 4 wherein, said shoe further includes means for engaging said portions of said rib as they slide along said recess and thereby creating increased frictional resistance of the shoe to movement along said rib.

6. The apparatus of claim 2, wherein said means for engaging said rib comprises a member which is movable with respect to said shoe.

7. The apparatus of claim 6, wherein said member movable with respect to said shoe is connected to said finger-like member extending out of said channel, whereby said movable member is operatively coupled to said sash.

8. The apparatus of claim 7, wherein said movable member and said shoe include a pair of contiguous surfaces which are slidable with respect to one another and which define an inclined plane extending at an acute angle with respect to said rib, such that said member is urged toward and against said rib with increased friction by relative movement of said slidable surfaces in response to the weight of said sash.

9. The apparatus of claim 8, wherein said pair of contiguous surfaces comprise generally planar surfaces disposed at complementary angles with respect to one another to form a pair of oppositely disposed interengaging wedge surfaces.

10. The apparatus of claim 9, wherein said movable member is elongated in shape and said wedge surfaces extend crosswise of the elongated sides of said member.

11. The apparatus of claim 10, wherein one of said surfaces comprises the lower end extremity of said movable member.

12. The apparatus of claim 11, wherein said moveable member includes a second said angular surface disposed above said one surface at lower end extremity thereof, whereby said member moves laterally through a series of generally parallel positions as said surfaces slide across their contiguous surfaces.

13. The apparatus set forth in any of claims 2, 4, 6, 7, 8 or 9, wherein said shoe includes means for frictionally engaging generally opposite sides of said rib.

14. The apparatus of claim 7, wherein said member movable with respect to said shoe is disposed within a cavity having a size and shape complementary thereto formed in said shoe, said member being carried with said shoe along said channel.

15. The apparatus of claim 14, wherein said cavity communicates with said recess which slidably receives at least portions of said rib, such that said moveable member contacts said rib as it passes through said recess.

16. The apparatus of claim 14, wherein said cavity has an opening communicating outwardly through a side of said shoe and said movable member contacts said rib along the periphery of said opening.

17. The apparatus of claim 16, wherein said cavity communicates with said recess which slidably receives at least portions of said rib, such that said moveable member contacts said rib as it passes through said recess.

18. The apparatus of claim 17, wherein said movable member contacts said rib on one side and forces its opposite side against the periphery of said recess to thereby create friction on opposite sides of said rib.

19. The apparatus of claim 18, wherein said movable member comprises a wedge and is disposed to be wedged against said rib in response to the weight of said sash.

20. The apparatus of claim 2, wherein said elongated rib is of generally T-shaped cross section.

21. The apparatus as set forth in claim 20, wherein said shoe includes means for frictionally engaging generally opposite sides of said T-shaped rib.

22. A jamb liner and sash positioner for a double-hung window, said jamb liner having guideway means at each side of the window sash forming a track along which at least one of the sash can slide, each said track having a pair of side walls spaced inwardly form the sides of the track and extending lengthwise thereof to define a channel between them, said channel having a slot-like opening in and extending the length of one sidewall thereof, a rib within and integral with the wall of said channel and extending lengthwise thereof, a shoe of a cross-sectional size and shape to be closely but slidably received within said channel, a tension spring extending lengthwise of said channel and having a first end which is secured to said shoe and a second end anchored with respect to said channel above said hook, said shoe having an internal cavity opening through a side of the shoe and having end walls closing at least one end of said cavity, said end walls having an opening of a size and shape to receive at least portions of said rib and thereby allow the same to pass through said shoe lengthwise thereof; wedge means seated in said cavity for sliding movement lengthwise thereof, means secured to said wedge means and extending externally of said channel to engage said sash, for supporting the weight of said sash and transmitting it to said wedge, said shoe and said wedge having interengaging surfaces shaped to urge said wedge means against said rib when said wedge is moved lengthwise of said cavity in response to the weight of the sash to provide frictional resistance to movement of the sash along the track, said frictional resistance having a magnitude which is a substantially direct function of the weight of the sash.

23. The apparatus of claim 22, wherein said track has a base wall and said side walls project outwardly from said base wall and generally toward said window sash, and wherein said channel is cross-sectionally closed except for said slot-like opening in one side wall thereof, and said opening located off center of said channel and nearer said base on one side than on the other.

24. The apparatus of claim 23, wherein said rib is located generally opposite from and across said channel with respect to said slot-like opening.

25. The apparatus of claim 22, wherein said means secured to said wedge means and engaging said sash comprises an elongated finger-like element having a portion external of and extending lengthwise of said shoe, said shoe having a lengthwise recess for at least partially seating said portion to restrain said finger-like element from pivoting about its attachment to said wedge means.

26. The apparatus of claim 25, wherein said shoe has a wall defining an elongated opening generally opposite said rib through which said finger-like element passes, said opening having a length which permits said wedge means to shift between wedging and release positions but which limits such shifting at said two positions.

* * * * *